US009090380B2

(12) United States Patent
Flanagan-Kent et al.

(10) Patent No.: US 9,090,380 B2
(45) Date of Patent: Jul. 28, 2015

(54) CONTAINER, HANDLE ATTACHMENT AND METHOD

(71) Applicants: Laura Flanagan-Kent, Decatur, GA (US); Stephen J. Kocis, Duluth, GA (US); David A. Hayward, Suwanee, GA (US); Frederick P. Minkemeyer, Rayland, OH (US); Gary L. Mengeu, Wheeling, WV (US); Edmund L. White, Johns Creek, GA (US)

(72) Inventors: Laura Flanagan-Kent, Decatur, GA (US); Stephen J. Kocis, Duluth, GA (US); David A. Hayward, Suwanee, GA (US); Frederick P. Minkemeyer, Rayland, OH (US); Gary L. Mengeu, Wheeling, WV (US); Edmund L. White, Johns Creek, GA (US)

(73) Assignee: Silgan Plastics LLC, Chesterfield, MO (US)

( * ) Notice: Subject to any disclaimer, the term of this patent is extended or adjusted under 35 U.S.C. 154(b) by 29 days.

(21) Appl. No.: 13/720,616

(22) Filed: Dec. 19, 2012

(65) Prior Publication Data

US 2014/0166677 A1 Jun. 19, 2014

(51) Int. Cl.

| | |
|---|---|
| ***B65D 23/10*** | (2006.01) |
| ***B65D 25/32*** | (2006.01) |
| ***B65D 25/28*** | (2006.01) |

(52) U.S. Cl.

CPC ..... *B65D 25/2867* (2013.01); *Y10T 29/49826* (2015.01)

(58) Field of Classification Search

CPC ..... B47J 45/061; B47J 46/065; B47J 45/071; B47J 45/075; B25G 3/18; B25G 3/32; B65D 23/10; B65D 23/104; B65D 23/106; B65D 23/108

USPC ..... 16/422, 425; 220/759, 760, 764, 773, 220/775, 776

See application file for complete search history.

(56) References Cited

U.S. PATENT DOCUMENTS

| | | | | |
|---|---|---|---|---|
| 2,665,822 | A * | 1/1954 | Crawford | 220/324 |
| 2,805,788 | A * | 9/1957 | Allbright et al. | 220/324 |
| 4,643,326 | A * | 2/1987 | Klingler | 220/710.5 |
| 5,054,170 | A | 10/1991 | Otrusina | |
| 5,201,858 | A | 4/1993 | Otrusina | |
| 5,347,693 | A | 9/1994 | Otrusina | |
| 5,365,631 | A * | 11/1994 | Emerick | 15/105 |
| 5,469,612 | A * | 11/1995 | Collette et al. | 29/453 |

(Continued)

OTHER PUBLICATIONS

U.S. Appl. No. 14/186,807, filed Feb. 21, 2014, Hayward et al.

(Continued)

*Primary Examiner* — Anthony Stashick
*Assistant Examiner* — Kaushikkumar Desai
(74) *Attorney, Agent, or Firm* — Reinhart Boerner Van Deuren s.c.

(57) ABSTRACT

A plastic container used for holding fluid material with an attachable handle is provided. The container includes a body, a plurality of walls, a spout, an attachable handle and a sliding structure. The spout is a hollow, cylindrical portion that extends from an opening in one of the walls. The cylindrical portion is configured to insert or remove the fluid material from the container. The attachable handle includes a rail structure that further includes a pair of non-parallel offset rails and a latch. The latch has a latching surface that is located at the ends of the offset rails farthest from each other. The slide structure includes a generally rectangular projection. The projection further includes a pair of non-parallel offset grooves and a latching surface. The latching surface is located where the grooves are farthest from each other. The offset grooves are adapted to mate with the offset rails and are fully engaged by the offset rails when the latch is engaged with the latching surface.

20 Claims, 10 Drawing Sheets

(56) References Cited

U.S. PATENT DOCUMENTS

| | | | | |
|---|---|---|---|---|
| 5,637,167 | A * | 6/1997 | Krishnakumar et al. | 156/85 |
| 6,037,872 | A * | 3/2000 | Dunnum | 340/586 |
| 7,464,834 | B2 * | 12/2008 | Law et al. | 222/129 |
| 7,600,655 | B2 * | 10/2009 | Agrawal et al. | 220/759 |
| 2007/0199954 | A1 * | 8/2007 | Law et al. | 222/129 |
| 2012/0097594 | A1 * | 4/2012 | Bruce | 210/238 |
| 2013/0048655 | A1 * | 2/2013 | Barth | 220/710.5 |

OTHER PUBLICATIONS

SKS Bottle & Packaging, Inc., Plastic Jugs, White HDPE F-Style Jugs with White Lined Ribbed Caps and White Plastic Bottles Only (Bulk), available at http://www.sks-bottle.com/340c/fin147a.html, believed to be available before Nov. 18, 2013, 2 pages.

* cited by examiner

CONTAINER, HANDLE ATTACHMENT AND METHOD

BACKGROUND OF THE INVENTION

The present invention relates to the field of molded plastic containers of the type and size requiring a carrying handle. In particular, the present invention relates to a handle molded separately from the container and attached to the container through an interaction of a tapered slide and rail arrangement provided between the container and the handle.

Molded plastic containers which require a carrying handle due to the type, weight or size of the container are typically molded as a one piece structure to include the handle. This has been the accepted way to provide a carrying container with a handle because it simplifies the handling and delivery of containers. Furthermore, the integral handle can be reliably configured to support the respective weight of a container and its designated content. Examples of such containers include plastic gas cans, plastic detergent bottles, plastic paint containers, plastic cleaning product bottles, etc.

SUMMARY OF THE INVENTION

For the present invention, the inventors have chosen to substantially deviate from the standard and typical way to provide molded plastic containers with handles.

One embodiment of the invention provides a plastic container body for holding a fluid material. The body includes a plurality of walls where one of the walls includes a hollow, cylindrical portion extending from an opening in the wall. This portion includes a threaded, exterior surface engageable by a cap, wherein the cylindrical portion is configured to insert or remove material from the container. The container also includes an attachable handle including a rail structure. The rail structure includes a pair of opposed, non-parallel, offset rails, and a latch having a latch surface located at the ends of the rails farthest from each other. The wall including the opening also includes a slide structure. The slide structure includes a generally rectangular projection including a pair of opposed, non-parallel offset grooves and a latching surface intersecting the grooves at the location where the grooves are farthest from each other. The grooves are adapted to mate with the offset rails and be fully engaged by the rails when the latch is engaged with the latching surface.

Another embodiment of the invention provides a plastic container body for holding a fluid material. The body includes a plurality of walls where one of the walls includes a hollow, cylindrical portion extending from an opening in the wall. This portion includes a threaded, exterior surface engageable by a cap, wherein the cylindrical portion is configured to insert or remove material from the container. The container also includes an attachable handle including a rail structure. The rail structure includes a pair of opposed, substantially equal length offset rails laying within a common plane, the rails each have a close end where the close ends of the rails are at a distance D1, and a distant end where the distant ends of the rails are a distance D2 greater than D1, and a latch having a latch surface located at the distant ends. The wall with the opening includes a slide structure including a generally rectangular projection extending from one of the walls. The projection includes a pair of opposed, offset grooves laying within a common plane. The grooves are adapted to mate with the offset rails, and a latching surface intersecting the grooves is located where the grooves mate with the distant ends of the rails. When the handle is properly attached to the container, the grooves and rails are fully engaged when the latch is engaged with the latching surface.

Another embodiment of the invention provides a method of delivering a plastic container body and handle which are molded at separate locations. In a first location, an attachable handle is molded to include a rail structure including a pair of opposed, non-parallel, offset rails, and a latch having a latch surface located at the ends of the rails farthest from each other. In a second location, different from the first location, a plastic container body for holding a fluid material is molded. The body includes a plurality of walls, a hollow, cylindrical portion extending from an opening in one of the walls, the portion including a threaded, exterior surface engageable by a cap, wherein the cylindrical portion is configured to insert or remove material from the container, and a slide structure including a generally rectangular projection from one of the walls. The projection includes a pair of opposed, non-parallel offset grooves and a latching surface intersecting the grooves at the location where the grooves are farthest from each other. The grooves are adapted to mate with the offset rails and be fully engaged by the rails when the latch is engaged with the latching surface. The method also includes a stop of causing at least one of the handle or the container to be delivered to a location where the handle is engaged with the container.

For all of these embodiments and variants thereof, the grooves could be exchanged with the rails depending upon the requirements for the container and attachable handle.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein the like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the figures, in one embodiment a container body that is molded without a handle and a separately molded attachable handle are provided. The container includes a handle attachment feature, such as a protrusion, that extends from one of the container walls. The attachable handle is configured to engage the protrusion to couple the attachable handle to the container body.

Figure 1:
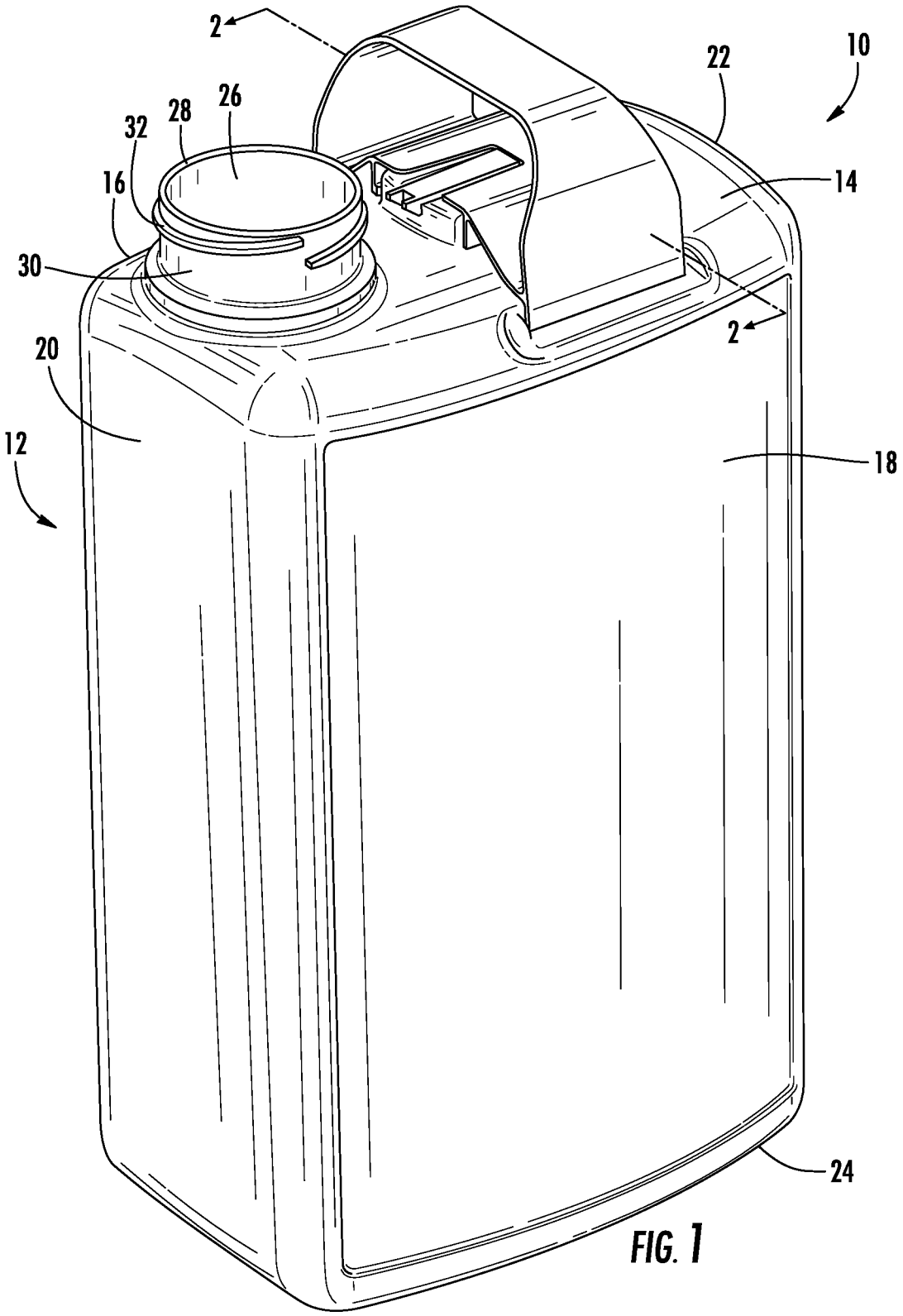
FIG. 1 is a full, perspective view of a plastic container and an attachable handle.

FIG. 1 illustrates an embodiment of a molded plastic container 10. The container 10 includes a container body 12 having a plurality of walls, including a top wall 14, a first side wall 16, a second side wall 18, a front end wall 20, a back end wall 22 and a bottom wall 24. The container body 12 defines an interior cavity configured to contain material (e.g., fluids, granular solids, liquids such as, for example, liquid detergent, water, bleach, herbicide, pesticide, etc.). The container body 12 is molded, all or in part, of plastic (e.g., blow molded from a thermoplastic such as polyethylene).

Referring to FIG. 1, the container body 12 further includes a circular opening 26 defined in the top wall 14. A generally hollow, cylindrical, annular spout 28 extends upwardly from the top wall 14 aligned with the opening 26. The spout 28 has an exterior surface 30. The exterior surface 30 includes a threaded portion 32. The threaded portion 32 is configured to be engageable with a cap (not shown). Materials may enter into the container body 12 from the exterior of the container 10 through the spout 28 when the cap is separated from the spout 28. The cap may then be engaged with the spout 28 to secure material inside the container body 12. Materials may be removed from the container body 12 by removing a cap and pouring the materials from the container body 12 out of the spout 28. In alternative embodiments, the spout 28 may extend from different walls of the container body 12. For example, the spout 28 may extend from the front end wall 20.

Figure 2:
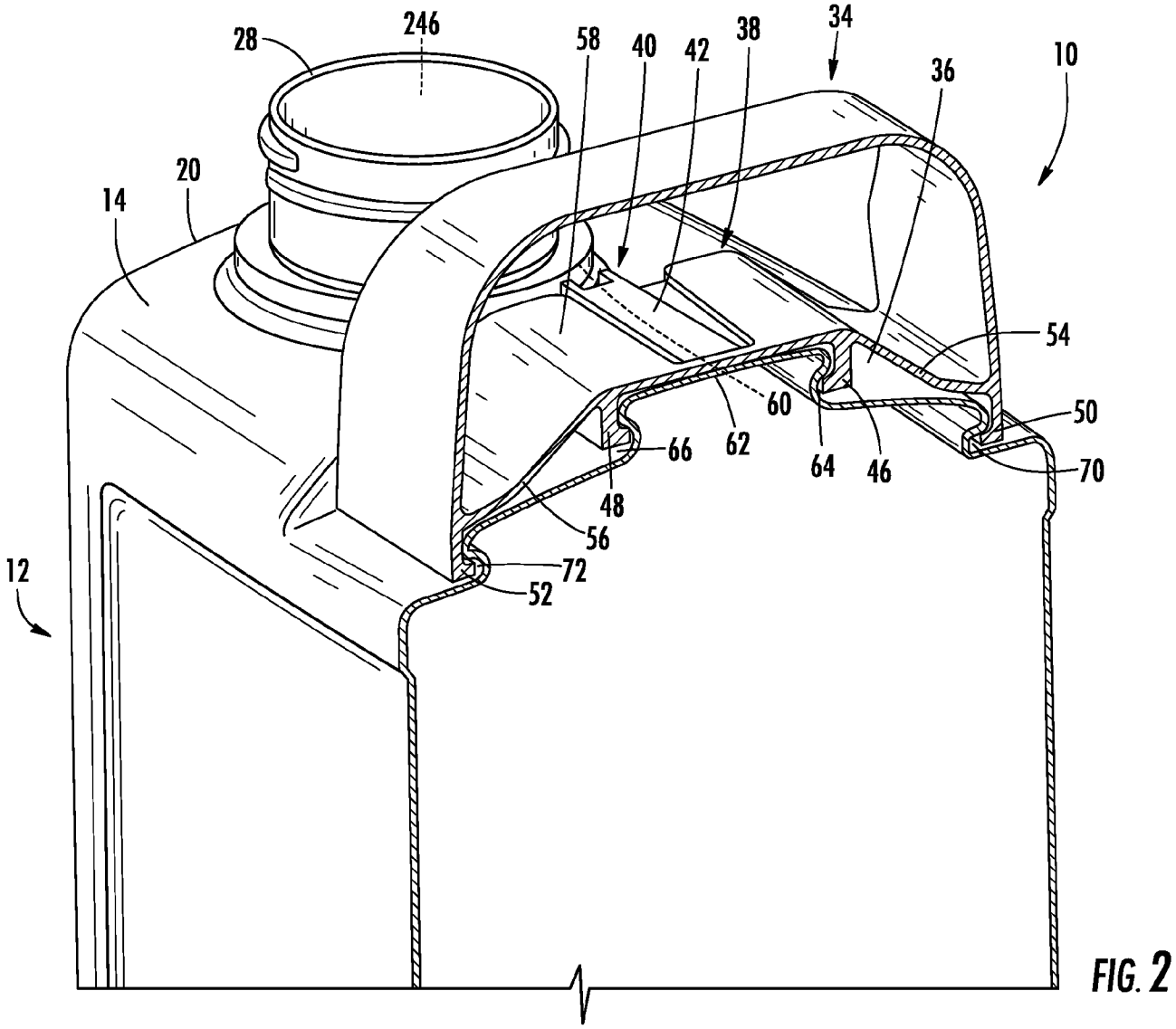
FIG. 2 is a perspective, sectional view of the container and handle taken along line 2-2 in FIG. 1.

Referring to FIG. 2, the container 10 further includes an attachable handle 34 and the container body 12 includes a slide structure 36 that is configured to engage with the attachable handle 34. The slide structure 36 extends upwardly from the top wall 14 of the container body 12. The attachable handle 34 is configured such that a user may grasp the attachable handle 34 engaged with the slide structure 36 to lift and move the container 10. For example, a user may grasp the attachable handle 34 and lift the container body 12 in an upward direction.

Referring to FIG. 2, the attachable handle 34 further includes a rail structure 38. The rail structure 38 includes a latch 40, a latch beam 42 and a latch surface 44 (shown in FIG. 5A), a first offset rail 46, a second offset rail 48, a first outboard rail 50, a second outboard rail 52, a first support structure 54, a second support structure 56, a bridge portion 58 and a rail axis 60. The latch 40 is located between the first offset rail 46 and the second offset rail 48. The slide structure 36 includes a projection 62. The slide structure 36 is formed on the sides of the projection 62. The projection 62 includes a first offset groove 64, a second offset groove 66 and a latching engagement surface 68 (shown in FIG. 3). Outboard grooves 70 and 72 are provided alongside of projection 62 at the top of container body 12 as shown in FIGS. 1-4 and 7-8. The first outboard rail 50 and the second outboard rail 52 are located outside of the first offset rail 46 and the second offset rail 48, respectively. The first outboard groove 70 and the second outboard groove 72 are located outside of the first offset groove 64 and the second offset groove 66, respectively. The first offset groove 64 is adapted to mate with the first offset rail 46. The second offset groove 66 is adapted to mate with the second offset rail 48. The first outboard groove 70 is adapted to mate with the first outboard rail 50. The second outboard groove 72 is adapted to mate with the second outboard rail 52. The attachable handle 34 may be engaged with the slide structure 36 when a portion of the first offset rail 46 is engaged with a portion of the first offset groove 64, a portion of the second offset rail 48 is engaged with a portion of the second offset groove 66, a portion of the first offset groove 64 is engaged with a portion of the first offset rail 46 and a portion of the second offset groove 66 is engaged with a portion of the second offset rail 48 at the same time. Additionally, the attachable handle 34 may be engaged with the slide structure 36 when a portion of the first outboard rail 50 is engaged with a portion of the first outboard groove 70, a portion of the second outboard rail 52 is engaged with a portion of the second outboard groove 72, a portion of the first outboard groove 70 is engaged with a portion of the first outboard rail 50 and a portion of the second outboard groove 72 is engaged with a portion of the second outboard rail 52 at the same time.

Referring to FIG. 2, the first offset rail 46 and the second offset rail 48 are engaged to the fullest extent with the first offset groove 64 and the second offset groove 66, respectively, when the latch surface 44 (shown in FIG. 5A) of the latch 40 is engaged with the latching engagement surface 68 (shown in FIG. 3) of the projection 62. The first outboard rail 50 and the second outboard rail 52 are engaged to the fullest extent with the first outboard groove 70 and the second outboard groove 72, respectively, when the latch surface 44 (shown in FIG. 5A) of the latch 40 is engaged with the latching engagement surface 68 (shown in FIG. 3) of the projection 62.

Referring to FIG. 2, the spout 28 has a vertical central axis 246 that extends from the top wall 14 to the bottom wall 24 (shown in FIG. 1). The container body 12 has a generally rectangular cross-section along any axis located between the front end wall 20 and the back end wall 22 (shown in FIG. 1) that is parallel with the vertical central axis 246.

Figure 3:
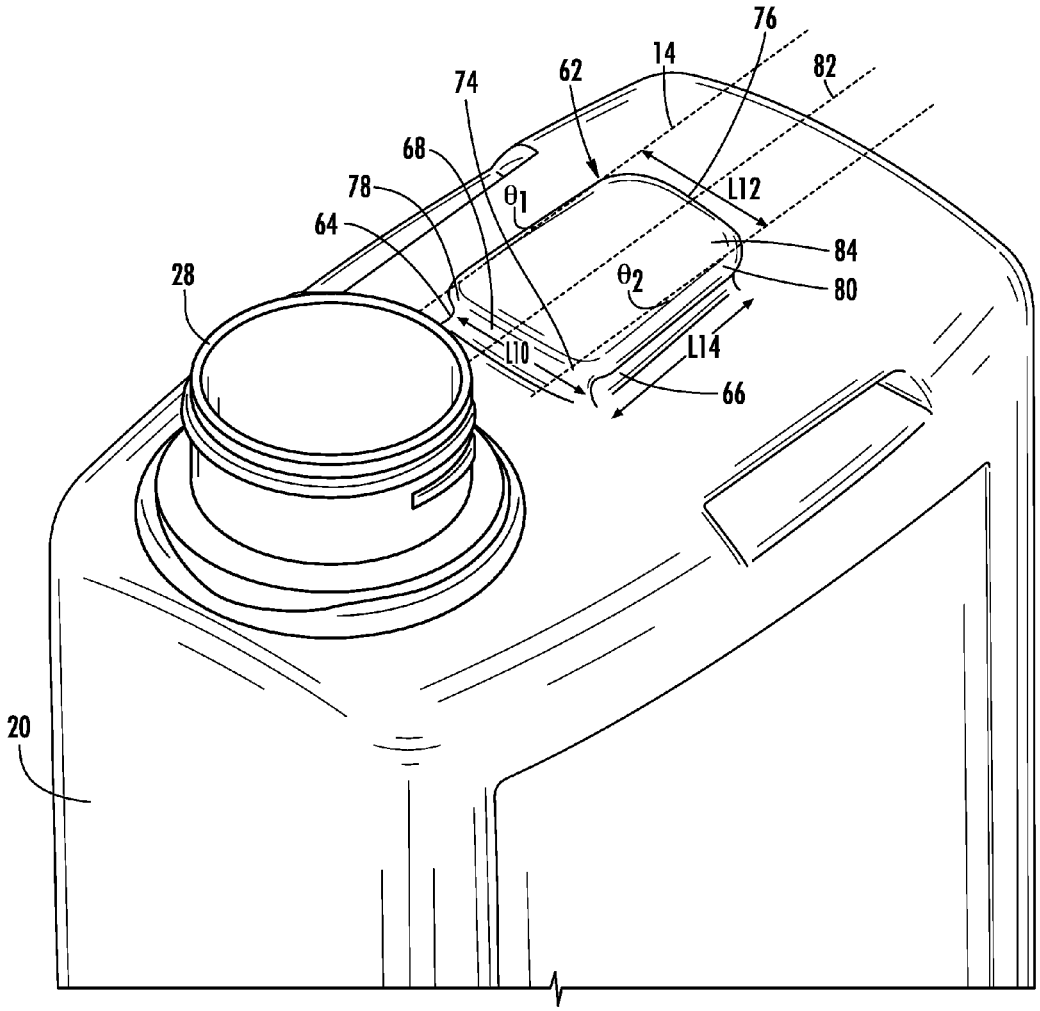
FIG. 3 is a perspective view of the container without the handle.

Referring to FIG. 3, the projection 62 is generally rectangular in shape extending from the top wall 14. The projection 62 includes a latch end 74, a rear end 76, a first projection overhang 78, a second projection overhang 80, a projection axis 82, a top surface 84, a rear surface (not shown), the first offset groove 64 and the second offset groove 66. The first offset groove 64 and the second offset groove 66 are non-parallel and located in a common plane on opposing sides of the projection 62. The latching engagement surface 68 is located at the latch end 74 of the projection 62. The latching engagement surface 68 extends upwardly from the top wall 14 to the top surface 84. A portion of the latching engagement surface 68 is adjacent to the first offset groove 64 and a portion of the latching engagement surface 68 is adjacent to the second offset groove 66. The first offset groove 64 extends from the latch end 74 to the rear end 76. The second offset groove 66 extends from the latch end 74 to the rear end 76. The rear surface is located at the rear end 76 of the projection 62. The rear surface extends upwardly from the top wall 14 to the top surface 84. A portion of the rear surface is adjacent to the first offset groove 64 and a portion of the rear surface is adjacent to the second offset groove 66. In one exemplary embodiment, the spout 28 extends from the same wall as the projection 62. For example, the spout 28 and the projection 62 may both extend from the top wall 14. In other embodiments, the spout 28 and the projection 62 may extend from different walls. For example, the projection 62 may extend from the top wall 14 and the spout 28 may extend from the front wall 20.

Referring to FIG. 3, the projection 62 has a length L10. The length L10 is the distance between the first offset groove 64 and the second offset groove 66 near the latch end 74. The projection 62 has a length L12. The length L12 is the distance between the first offset groove 64 and the second offset groove 66 near the rear end 76. The length L10 is greater than the length L12. The first offset groove 64 and the second offset groove 66 are the farthest from each other at the point where the latching engagement surface 68 intersects with the first offset groove 64 and the second offset groove 66. For example, in one embodiment, the length L10 may be 1.3 centimeters and the length L12 may be 1.15 centimeters. Alternative embodiments may have the length L10 that is greater than or less than 1.3 centimeters and the length L12 that is greater than or less than 1.15 centimeters. For example, an alternative embodiment may have a length L10 that is between 1.0 and 1.5 centimeters and the length L12 may be between 0.85 and 1.35 centimeters, more specifically length L10 may be 1.5 centimeters and length L12 may be 0.90 centimeters.

Referring to FIG. 3, the first offset groove 64 has a length (not shown) that extends from the rear end 76 to the latch end 74 of the projection 62. The second offset groove 66 has a length L14 that extends from the rear end 76 to the latch end 74. The length of the first offset groove 64 and the length L14 are substantially of equal lengths. For example, in one embodiment, the first offset groove 64 may have the length of 2.00 centimeters and the length L14 may be 2.00 centimeters. Alternative embodiments may have the first offset groove 64 that has the length that is less than or greater than 2.00 centimeters and a length L14 that is less than or greater than 2.0 centimeters. For example, an alternative embodiment may have the first offset groove 64 that has the length of 3.2 centimeters and the length L14 that is 3.2 centimeters. Alternative embodiments may have a first offset groove 64 that has a different length than the length L14 to engage with attachable handles 34 of various sizes and configurations. For example, the first offset groove 64 may have a length between 1.5 and 2.5 centimeters and the length L14 may be between 1.5 and 2.5 centimeters, more specifically, the first offset groove 64 may have the length of 2.3 centimeters and the length L14 may be 1.7 centimeters.

Referring to FIG. 3, the first offset groove 64 and the second offset groove 66 are non-parallel with each other and have the common longitudinal projection axis 82. The first offset groove 64 and the second offset groove 66 gradually angle away from the projection axis 82 as the first offset groove 64 and the second offset groove 66 extend from the rear end 76 to the latch end 74. The first offset groove 64 has a first angle $\theta_1$. The second offset groove 66 has a second angle $\theta_2$. The first angle $\theta_1$ is the angle between a line that is parallel with the projection axis 82 extending from the rear end 76 to the latch end 74 near the first offset groove 64 and the first offset groove 64. The second angle $\theta_2$ is the angle between a line that is parallel with the projection axis 82 extending from the rear end 76 to the latch end 74 near the second offset groove 66 and the second offset groove 66. The first angle $\theta_1$ and the second angle $\theta_2$ are substantially similar. For example, in one embodiment, the first angle $\theta_1$ is between 1° and 3° and the second angle $\theta_2$ is between 1° and 3°, more specifically the first angle $\theta_1$ may be 2° and the second angle $\theta_2$ may be 2°. Alternative embodiments may have a first angle $\theta_1$ that is greater than 3° and a second angle $\theta_2$ that is greater than 3°. For example, the first angle $\theta_1$ may be 5° and the second angle $\theta_2$ may be 5°. Alternative embodiments may also include the first angle $\theta_1$ that is a different degree than the second angle $\theta_2$. For example, the first angle $\theta_1$ may be 2° and the second angle $\theta_2$ may be 4°.

Figure 4A:
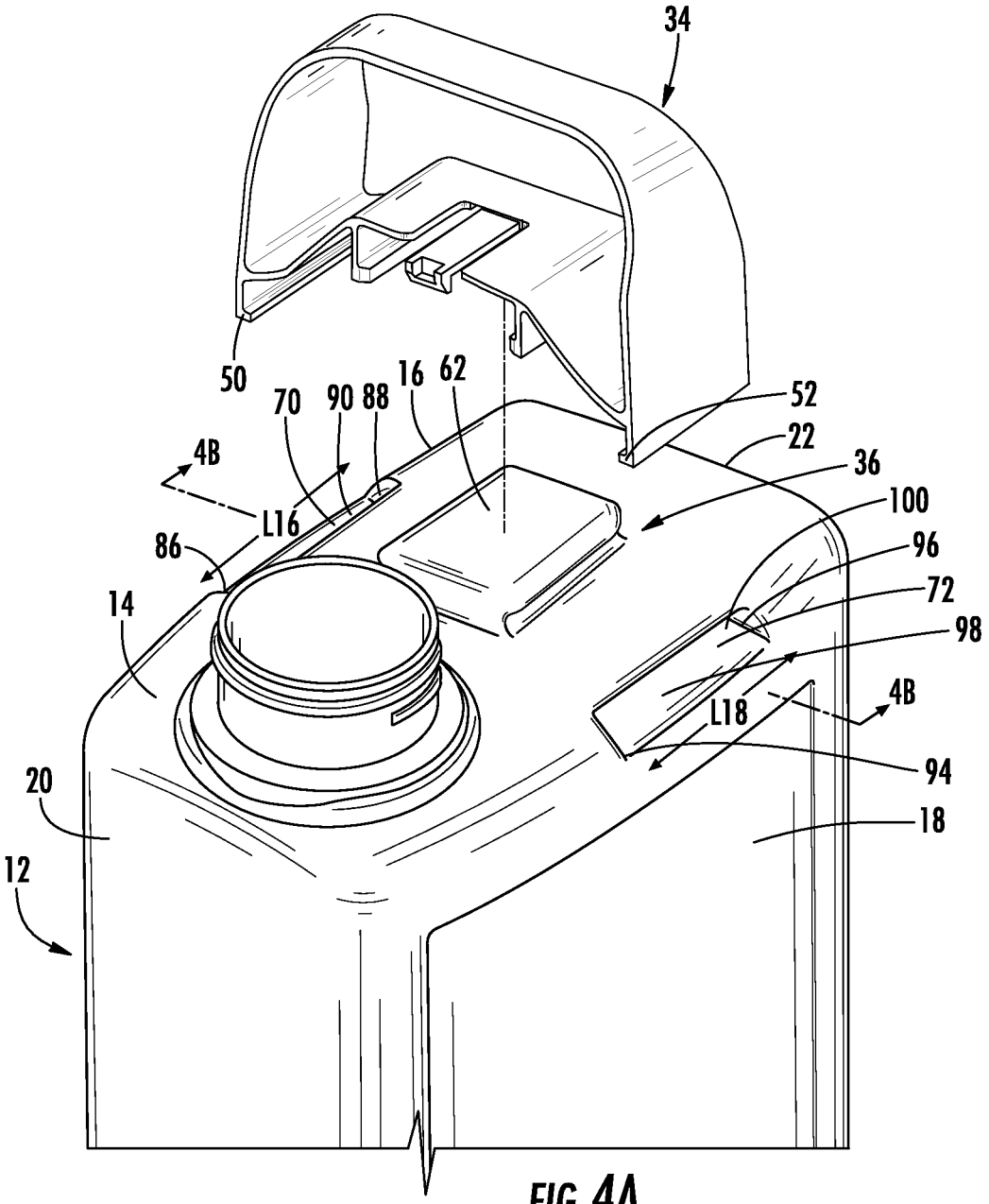
FIG. 4A is an exploded view of the slide structure on top of the container.

Referring to FIG. 4A, the container body 12 includes the first outboard groove 70 and the second outboard groove 72. The first outboard groove 70 is between the front end wall 20 and the back end wall 22 extending between portions of the top wall 14 and the first side wall 16. The second outboard groove 72 is between the front end wall 20 and the back end wall 22 extending between portions of the top wall 14 and the second side wall 18. The first outboard groove 70 further includes a first front surface 86, a first back surface 88, a first bottom surface 90, a first indent portion 92 (shown in FIG. 4B) and a length L16. The second outboard groove 72 further includes a second front surface 94, a second back surface 96, a second bottom surface 98, a second indent portion 100 and a length L18. The length L16 is the distance between the first front surface 86 and the first back surface 88. The length L18 is the distance between the second front surface 94 and the second back surface 96. The length L16 and the length L18 are substantially similar. For example, in one embodiment, the length L16 may be 2.1 centimeters and the length L18 may be 2.1 centimeters. Alternative embodiments may have the length L16 that is less than or greater than 2.1 centimeters and a length L18 that is less than or greater than 2.1 centimeters. For example, an alternative embodiment may have a length L16 of 2.6 centimeters and a length L18 that is 2.6 centimeters. Alternative embodiments may have a length L16 that is a different length than the length L18 to to engage with attachable handles 34 of various sizes and configurations. For example, the length L16 may be between 1.6 and 2.6 centimeters and the length L18 may be between 1.6 and 2.6 centimeters, more specifically, the length L16 may be 1.8 centimeters and the length L18 may be 2.4 centimeters.

Referring to FIG. 4A, the projection 62 of the slide structure 36 is configured to engage with a portion of the attachable handle 34. The first outboard groove 70 is configured to engage with the first outboard rail 50 and the second outboard groove 72 is configured to engage with the second outboard rail 52.

Figure 4B:
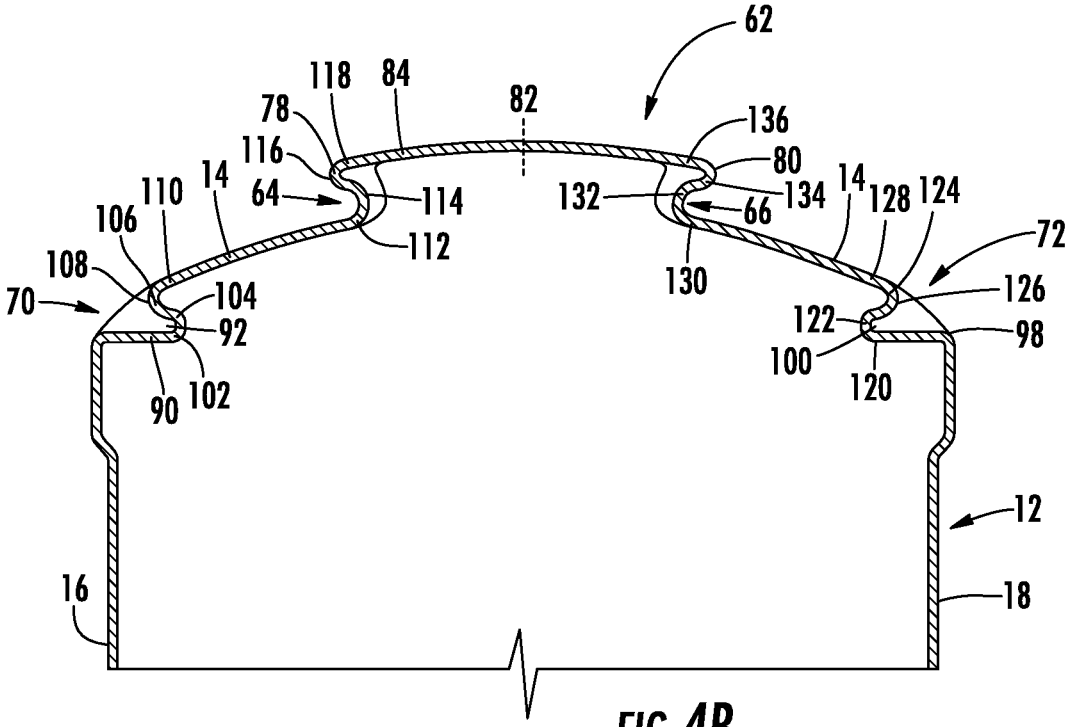
FIG. 4B is a sectional view of the handle taken along line 4B-4B in FIG. 4A.

Referring to FIG. 4B, the container body 12 has a portion of the first side wall 16 extending upwards to the top wall 14 and a portion of the first side wall 16 extending upwards to the first outboard groove 70. The first bottom surface 90 of the first outboard groove 70 is adjacent to a portion of the first side wall 16. The first bottom surface 90 extends radially inwards towards the first indent portion 92. The first indent portion 92 is rounded and has a lower portion 102 and an upper portion 104. The lower portion 102 is adjacent to the first bottom surface 90 and extends at an upwards angle towards the upper portion 104. The upper portion 104 extends at an upwards angle towards a first groove overhang portion 106. The first groove overhang portion 106 has a lower portion 108 and an upper portion 110. The lower portion 108 is adjacent to upper portion 104 of the first indent portion 92. The upper portion 110 is adjacent to the top wall 14. The top wall 14 and the first groove overhang portion 106 conjoin with each other forming a rounded edge. The top wall 14 extends at an upwards angle towards the first offset groove 64. The first offset groove 64 has a lower portion 112 and an upper portion 114. The lower portion 112 is adjacent to the top wall 14 and the upper portion 114 extends at an upwards angle towards the first projection overhang 78. The first projection overhang 78 has a lower portion 116 and an upper portion 118. The lower portion 116 is adjacent to upper portion 114 of the first offset groove 64. The upper portion 118 is adjacent to the top surface 84 of the projection 62. The top surface 84 and the first projection overhang 78 conjoin with each other forming a rounded edge.

Referring to FIG. 4B, the top surface 84 extends away from the first projection overhang 78 to towards the second projection overhang 80. The top surface 84 extends at an upwards angle from the first projection overhang 78 to the projection axis 82. The top surface 84 extends at a downwards angle from the projection axis 82 to the second projection overhang 80. Alternative embodiments may include the top surface 84 to form a horizontal plane that extends from the first projection overhang 78 to the second projection overhang 80.

Referring to FIG. 4B, the container body 12 has a portion of the second side wall 18 extending upwards to the top wall 14 and a portion of the second side wall 18 extending upwards to the second outboard groove 72. The second bottom surface 98 of the second outboard groove 72 is adjacent to a portion of the second side wall 18. The second bottom surface 98 extends radially inwards towards the second indent portion 100. The second indent portion 100 is rounded and has a lower portion 120 and an upper portion 122. The lower portion 120 is adjacent to the second bottom surface 98 and extends at an upwards angle towards the upper portion 122. The upper portion 122 extends at an upwards angle towards a second groove overhang portion 124. The second groove overhang portion 124 has a lower portion 126 and an upper portion 128. The lower portion 126 is adjacent to upper portion 122 of the second indent portion 100. The upper portion 128 is adjacent to the top wall 14. The top wall 14 and the second groove overhang portion 124 conjoin with each other forming a rounded edge. The top wall 14 extends at an upwards angle towards the second offset groove 66. The second offset groove 66 has a lower portion 130 and an upper portion 132. The lower portion 130 is adjacent to the top wall 14 and the upper portion 132 extends at an upwards angle towards the second projection overhang 80. The second projection overhang 80 has a lower portion 134 and an upper portion 136. The lower portion 134 is adjacent to upper portion 132 of the second offset groove 66. The upper portion 136 is adjacent to the top surface 84 of the projection 62. The top surface 84 and the second projection overhang 80 conjoin with each other forming a rounded edge.

Figure 5A:
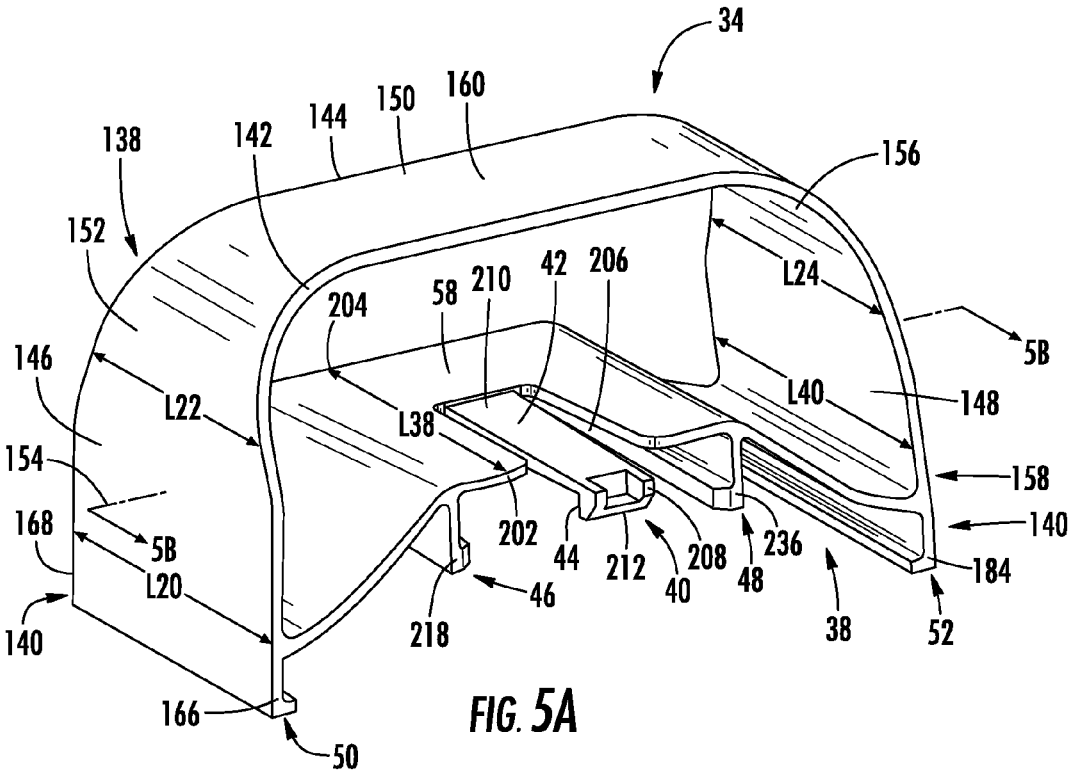
FIG. 5A is an exploded, perspective view of the handle.

Referring to FIG. 5A, the attachable handle 34 includes a grip portion 138 and an attachment portion 140. The grip portion 138 includes a front end 142, a back end 144, a first side end 146, a second side end 148 and a top portion 150. The attachment portion 140 includes the rail structure 38, the latch 40, the latch beam 42 and the latch surface 44. The grip portion 138 forms a general U-shape extending from the first outboard rail 50 to the second outboard rail 52. The attachable handle 34 may be molded from a variety of types of plastic (e.g., thermoplastics). For example, the exemplary embodiment has an attachable handle 34 that is molded from a high density polyethylene resin. Alternative embodiments may include attachable handles 34 molded from other thermoplastics (e.g., polypropylene, polystyrene, etc.), thermosetting polymers (e.g., polyurethanes) or combination of multiple plastics.

Referring to FIG. 5A, the first side end 146 includes a first grip end portion 152 and a first attachment end portion 154. The first attachment end portion 154 extends from the front end 142 to the back end 144. The first attachment end portion 154 has a length L20. The length L20 is the distance between the front end 142 and the back end 144 at the first attachment end portion 154. The first attachment end portion 154 is adjacent to the attachment portion 140, more specifically, the first outboard rail 50. The first attachment end portion 154 extends in an upward direction towards the first grip end portion 152. The first grip end portion 152 extends from the front end 142 to the back end 144. The first grip end portion 152 has a length L22. The length L22 is the distance between the front end 142 and the back end 144 at the first grip end portion 152. The length L20 is greater than the length L22. For example, in one embodiment, the length L20 may be 1.96 centimeters and the length L22 may be 1.64 centimeters. Alternative embodiments may have the length L20 that is greater than or less than 1.96 centimeters and the length L22 that is greater than or less than 1.64 centimeters. For example, an alternative embodiment may have a length L20 that is between 1.46 and 2.46 centimeters and the length L22 that is between 1.14 and 2.14 centimeters, more specifically, length L20 may be 2.1 centimeters and L22 may be 2.0 centimeters.

Referring to FIG. 5A, the second side end 148 includes a second grip end portion 156 and a second attachment end portion 158. The second attachment end portion 158 extends from the front end 142 to the back end 144. The second attachment end portion 158 has a length L40. The length L40 is the distance between the front end 142 and the back end 144 at the second attachment end portion 158. The second attachment end portion 158 is adjacent to the attachment portion 140, more specifically, the second outboard rail 52. The second attachment end portion 158 extends in an upward direction towards the second grip end portion 156. The second grip end portion 156 extends from the front end 142 to the back end 144. The second grip end portion 156 has a length L24. The length L24 is the distance between the front end 142 and the back end 144 at the second grip end portion 156. The length L40 is greater than the length L24. For example, in one embodiment, the length L40 may be 1.96 centimeters and the length L24 may be 1.64 centimeters. Alternative embodiments may have the length L40 that is greater than or less than 1.96 centimeters and the length L24 that is greater than or less than 1.64 centimeters. For example, an alternative embodiment may have a length L40 that is between 1.46 and 2.46 centimeters and the length L24 that is between 1.14 and 2.14 centimeters, more specifically, length L40 may be 2.1 centimeters and L24 may be 2.0 centimeters.

Referring to FIG. 5A, the top portion 150 extends from the first grip end portion 152 to the second grip end portion 156 forming a horizontal plane 160. A portion of the horizontal plane 160 is parallel with a portion of the attachment portion 140. The top portion 150 conjoins with the first grip portion 152 and the second grip portion 156 forming rounded edges.

Figure 5B:
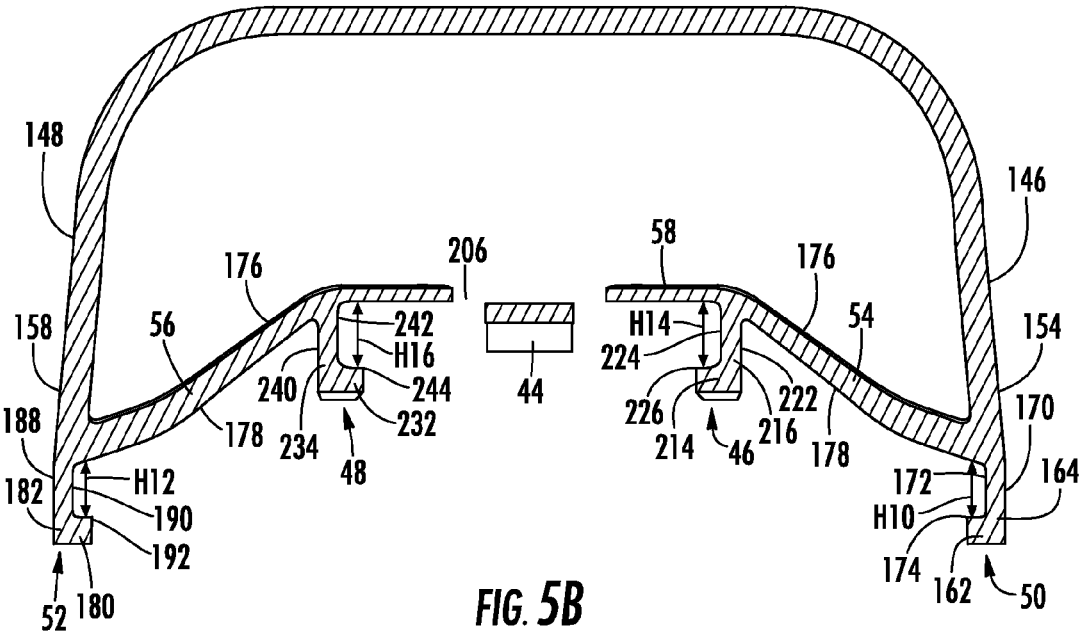
FIG. 5B is a section view of the handle taken along line 5B-5B in FIG. 5A.
Figure 6:
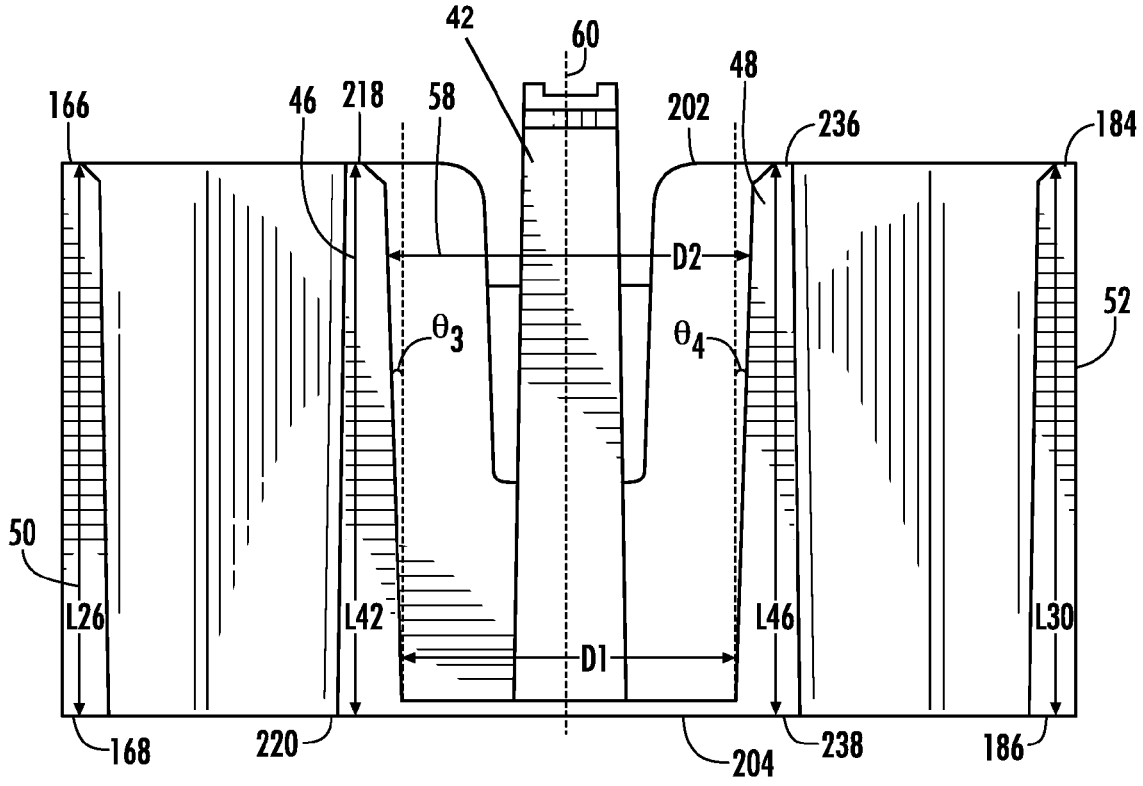
FIG. 6 is a bottom view of the handle.

Referring to FIG. 5A and FIG. 5B, the first outboard rail 50 includes a first flange 162, a first rail portion 164, a front end 166, a back end 168 and a length L26 (shown in FIG. 6). The length L26 is the distance between the front end 166 and the back end 168. The first rail portion 164 is adjacent to the first attachment end portion 154 on the first side end 146. The first rail portion 164 includes an exterior surface 170 and an interior surface 172. The first rail portion 164 extends downwards from the first side end 146 towards the first flange 162. The first flange 162 extends from the first rail portion 164 radially inwards towards the second outboard rail 52. The first flange 162 includes a first bottom groove surface 174. The first bottom groove surface 174 extends towards the interior surface 172. The interior surface 172 extends away from the first bottom groove surface 174 and upwards towards the first support structure 54. The first support structure 54 has a grip surface 176 and a container surface 178. The container surface 178 is adjacent to the interior surface 172. The interior surface 172 has a height H10. The height H10 is the distance between the first bottom groove surface 174 and the container surface 178. The first outboard rail 50 is configured to receive the first groove overhang portion 106 (shown in FIG. 4B). The first indent portion 92 (shown in FIG. 4B) is configured to receive the first outboard rail 50.

Referring to FIG. 5A and FIG. 5B, the second outboard rail 52 includes a second flange 180, a second rail portion 182, a front end 184, a back end 186 (shown in FIG. 6) and a length L30 (shown in FIG. 6). The length L30 is the distance between the front end 184 and the back end 186. The second rail portion 182 is adjacent to the second attachment end portion 158 on the second side end 148. The second rail portion 182 includes an exterior surface 188 and an interior surface 190. The second rail portion 182 extends downwards from the second side end 148 towards the second flange 180. The second flange 180 extends from the second rail portion 182 radially inwards towards the first outboard rail 50. The second flange 180 includes a second bottom groove surface 192. The second bottom groove surface 192 extends towards the interior surface 190. The interior surface 190 extends away from the second bottom groove surface 192 and upwards towards the second support structure 56. The second support structure 56 has the grip surface 176 and a container surface 178 that is adjacent to the interior surface 190. The interior surface 190 has a height H12. The height H12 is the distance between the second bottom groove surface 192 and the container surface 178. The second outboard rail 52 is configured to receive the second groove overhang portion 124. The second indent portion 100 is configured to receive the second outboard rail 52. The first outboard rail 50 and the second outboard rail 52 are generally non-parallel with each other.

Referring to FIG. 5B, the height H10 and the height H12 are substantially similar. For example, in one embodiment, the height H10 may be 0.227 centimeters and the height H12 may be 0.227 centimeters. Alternative embodiments may have the height H10 that is less than or greater than 0.227 centimeters and a height H12 that is less than or greater than 0.227 centimeters. For example, an alternative embodiment may have the height H10 of 0.350 centimeters and the height H12 that is 0.350 centimeters. Alternative embodiments may have the height H10 that is a different height than the height H12 to engage with slide structures 36 of various sizes and configurations. For example, the height H10 may be between 0.177 and 0.277 centimeters and the height H12 may be between 0.177 and 0.277 centimeters, more specifically, the height H10 may be 0.200 centimeters and the height H12 may be 0.250 centimeters.

Referring to FIG. 5B, the first support structure 54 is adjacent to portions of the first side end 146 and the first rail portion 164. The first support structure 54 extends at an upward angle radially inwards away from the first side end 146 and the first rail portion 164 and towards the bridge portion 58.

Referring to FIG. 5B, the second support structure 56 is adjacent to portions of the second side end 148 and the second rail portion 182. The second support structure 56 extends at an upward angle radially inwards away from the second side end 148 and the second rail portion 182 and towards the bridge portion 58.

Referring to FIG. 5A and FIG. 5B, the bridge portion 58 includes a front end 202 and a back end 204. The bridge portion 58 extends from the first support structure 54 towards the second support structure 56. The bridge portion 58 includes a length L38. The length L38 is the distance between the front end 202 and the back end 204. The length L38 is less than or equal to the length L26 of the first outboard rail 50 and the length L30 of the second outboard rail 52. The length L38 is greater than the length L22 and length L24 of the first grip portion and the second grip portion, respectively. For example, in one embodiment, the length L38 is 1.96 centimeters. Alternative embodiments may have the length L38 that is less than or greater than 1.96 centimeters. For example, the length L38 may be 2.2 centimeters.

Referring to FIGS. 5A and 5B, the bridge portion 58 further includes a bridge opening 206. The bridge opening 206 is configured to receive the latch beam 42. The latch beam 42 is located between the first support structure 54 and the second support structure 56. The latch beam 42 further includes a latch portion 208, an attachment end 210 and a latch end 212. The latch end 212 is located near the front end 202 of the bridge portion 58. The latch portion 208 is located at the latch end 212 of the latch beam 42. The latch portion 208 is perpendicular with the latch beam 42. The latch portion 208 extends downwards at a 90° angle towards the container body 12. The latch portion 208 includes the latch surface 44. The latch surface 44 is configured to engage with the latching engagement surface 68 on the slide structure 36 when the attachable handle 34 is coupled to the container body 12. The attachment end 210 is coupled to the bridge portion 58. The coupling between the bridge portion 58 and the attachment end 210 allows the latch beam 42 and the latch portion 208 to move independently from the rest of the attachable handle 34. For example, when pressure is applied to the top portion of the latch beam 42, the latch portion 208 may move in a downward direction, away from the bridge portion 58.

Referring to FIGS. 5A and 5B, the first offset rail 46 and the second offset rail 48 are located on opposing sides of the latch beam 42. The first offset rail 46 further includes a first offset flange 214, a first offset rail portion 216, a front end 218, a back end 220 (shown in FIG. 6), an exterior surface 222, an interior surface 224 and a length L42 (shown in FIG. 6). The length L42 is the distance from the front end 218 to the back end 220. The first offset rail portion 216 is adjacent to portions of the bridge portion 58 and the first support structure 54. The first offset rail portion 216 extends downwards away from the bridge portion 58 and the first support structure 54 and towards the first offset flange 214. The first offset flange 214 extends from the first offset rail portion 216 radially inwards towards the second offset rail 48. The first offset flange 214 includes a first projection groove surface 226. The first projection groove surface 226 is adjacent to the interior surface 224. The interior surface 224 extends from the first projection groove surface 226 and upwards towards the bridge portion 58. The bridge portion 58 further includes the grip surface 176 and the container surface 178 that is adjacent to the interior surface 224. The interior surface 224 has a height H14. The height H14 is the distance between the first projection groove surface 226 and the container surface 178. The first offset rail 46 is configured to receive the first projection overhang portion 78. The first offset groove 64 is configured to receive the first offset rail 46.

Referring to FIGS. 5A and 5B, the second offset rail 48 further includes a second offset flange 232, a second offset rail portion 234, a front end 236, a back end 238 (shown in FIG. 6), an exterior surface 240, an interior surface 242 and a length L46 (shown in FIG. 6). The length L46 is the distance from the front end 236 to the back end 238. The second offset rail portion 234 is adjacent to portions of the bridge portion 58 and the second support structure 56. The second offset rail portion 234 extends downwards away from the bridge portion 58 and the second support structure 56 towards the second offset flange 232. The second offset flange 232 extends from the second offset rail portion 234 radially inwards towards the first offset rail 46. The second offset flange 232 includes a second projection groove surface 244. The second projection groove surface 244 is adjacent to the interior surface 242. The interior surface 242 extends from the second projection groove surface 244 and upwards towards the bridge portion 58. The bridge portion 58 has the grip surface 176 and the container surface 178 that is adjacent to the interior surface 242. The interior surface 242 has a height H16. The height H16 is the distance between the second projection groove surface 244 and the container surface 178. The second offset rail 48 is configured to receive the second projection overhang 80. The second offset groove 66 is configured to receive the second offset rail 48.

Referring to FIG. 5B, the height H14 and the height H16 are substantially similar. For example, in one embodiment, the height H14 may be 0.294 centimeters and the height H12 may be 0.294 centimeters. Alternative embodiments may have the height H14 that is less than or greater than 0.294 centimeters and a height H16 that is less than or greater than 0.294 centimeters. For example, an alternative embodiment may have the height H14 of 0.375 centimeters and the height H16 that is 0.375 centimeters. Alternative embodiments may have the height H14 that is a different height than the height H16 to engage with slide structures 36 of various sizes and configurations. For example, the height H14 may be between 0.244 and 0.377 centimeters and the height H16 may be between 0.244 and 0.377 centimeters, more specifically, the height H14 may be 0.265 centimeters and the height H16 may be 0.325 centimeters.

Referring to FIG. 6, the length L42 and the length L46 are substantially of equal lengths that are located in a common plane. The length L26 and the length L30 are substantially of equal lengths that are located in a common plane. For example, in one embodiment the length L42 may be 1.96 centimeters and the length L46 may be 1.96 centimeters and the length L26 may be 1.96 centimeters and the length L30 may be 1.96 centimeters. Alternative embodiments may have the length L42 that is less than or greater than 1.96 centimeters, the length L46 that is less than or greater than 1.96 centimeters, the length L26 that is less than or greater than 1.96 centimeters and the length L30 that is less than or greater than 1.96 centimeters. For example, an alternative embodiment may have the length L42, the length L46, the length L26 and the length L30 that are between 1.46 and 2.46 centimeters, more specifically, length L42 may be 2.1 centimeters and length L46 may be 2.1 centimeters and length L26 may be 2.2 centimeters and L30 may be 2.2 centimeters.

Referring to FIG. 6, the first offset rail 46 and the second offset rail 48 are non-parallel with each other and located in a common plane on opposing sides of the latch beam 42 having the common longitudinal rail axis 60. The first offset rail 46 and the second offset rail 48 gradually angle away from the rail axis 60 as the first offset rail 46 extends from the back end 220 to the front end 218 and the second offset rail 48 extends from the back end 238 to the front end 236. The first offset rail 46 has a first angle $\theta_3$. The second offset rail 48 has a second angle $\theta_4$. The first angle $\theta_3$ is the angle between a line that is parallel with the rail axis 60 extending from the back end 220 to the front end 236 near the first offset rail 46 and the first offset rail 46. The second angle $\theta_4$ is the angle between a line that is parallel with the rail axis 60 extending from the back end 238 to the front end 236 near the second offset rail 48 and the second offset rail 48. The first angle $\theta_3$ and the second angle $\theta_4$ are substantially similar. The first angle $\theta_1$ is substantially similar to the first angle $\theta_3$ and the second angle $\theta_2$ is substantially similar to the second angle $\theta_4$. For example, in one embodiment, the first angle $\theta_1$ is between 1° and 3° and the first angle $\theta_3$ is between 1° and 3° and the second angle $\theta_2$ is between 1° and 3° and the second angle $\theta_4$ is between 1° and 3°, more specifically the first angle $\theta_1$ may be 2°, the second angle $\theta_2$ may be 2°, the first angle $\theta_3$ may be 2°, and the second angle $\theta_4$ may be 2°. Alternative embodiments may have a first angle $\theta_3$ that is greater than 3° and a second angle $\theta_4$ that is greater than 3°. For example, the first angle $\theta_3$ may be 5° and the second angle $\theta_4$ may be 5°. Alternative embodiments may also include the first angle $\theta_3$ that is a different degree than the second angle $\theta_4$. For example, the first angle $\theta_3$ may be 2° and the second angle $\theta_4$ may be 4°.

Referring to FIG. 6, the first offset rail 46 and the second offset rail 48 have a close end distance D1 and a distant end distance D2. The close end distance D1 is the distance between the first offset rail 46 and the second offset rail 48 near the back end 204 of the bridge portion 58. The distant end distance D2 is the distance between the first offset rail 46 and the second offset rail 48 near the front end 202 of the bridge portion 58. The distant end distance D2 is greater than the close end distance D1 and the distant end distance D2 is between 5% and 15% greater than the close end distance D1. The latch surface 44 (shown in FIG. 5A) is located near the front end 218 and the front end 236 of the first offset rail 46 and the second offset rail 48, respectively, where the distant end distance D2 is the greatest. For example, in one embodiment, the close end distance D1 is 1.194 centimeters and the distant end distance D2 is 1.322 centimeters, therefore the distant end distance D2 is 9.7% greater than the close end distance D1. Alternative embodiments may have the distant end distance D2 that is less than 5% greater than the close end distance D1 or the distant end distance D2 may be greater than 15% greater than the close end distance D1.

Figure 7:
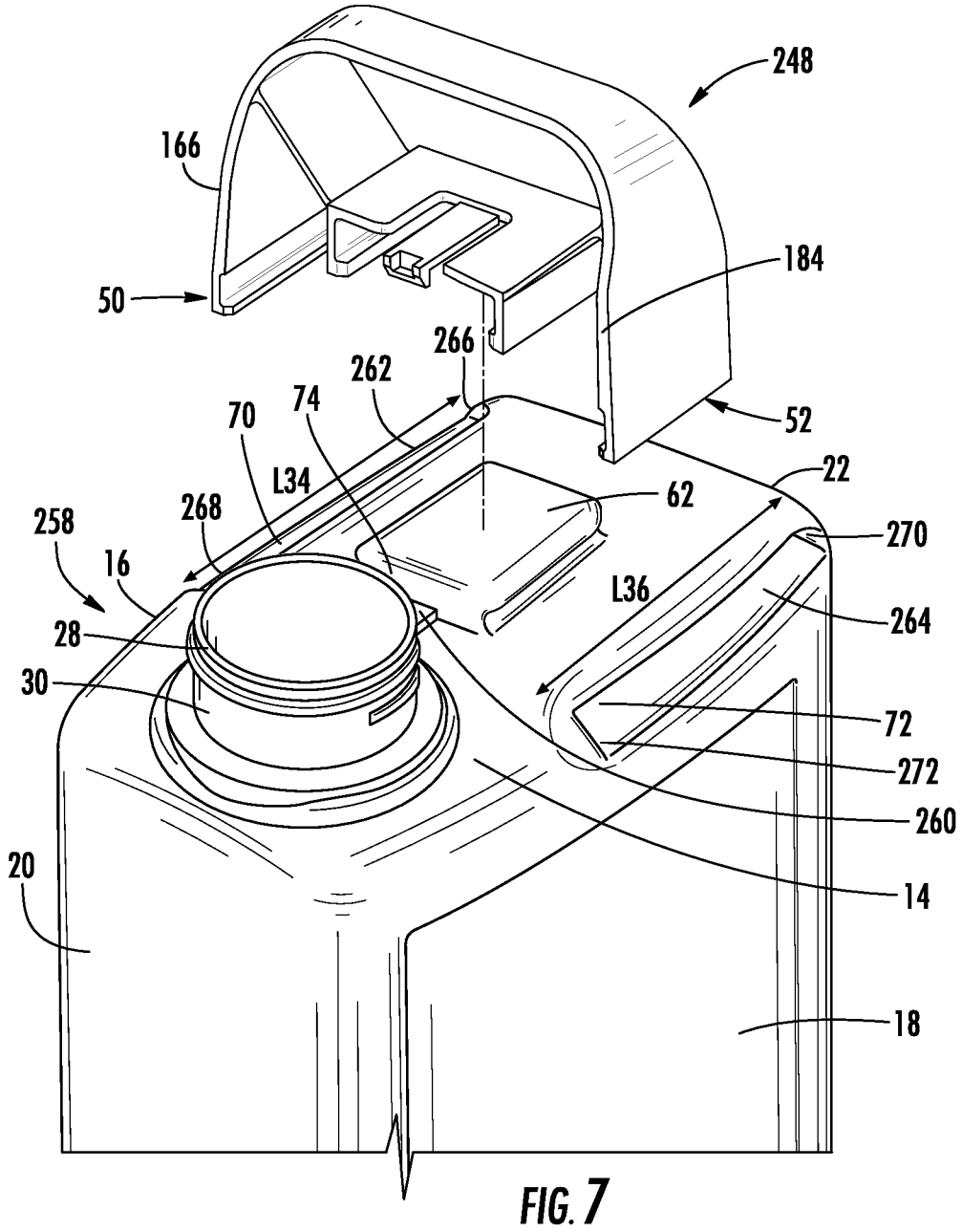
FIG. 7 is an exploded view of the slide structure on top of the container.

Referring to FIG. 7, another embodiment of the container body 258 is similar to the container body 12. The container body 258 and the container body 12 both include the first outboard groove 70, the second outboard groove 72 and the projection 62.

Figure 8:
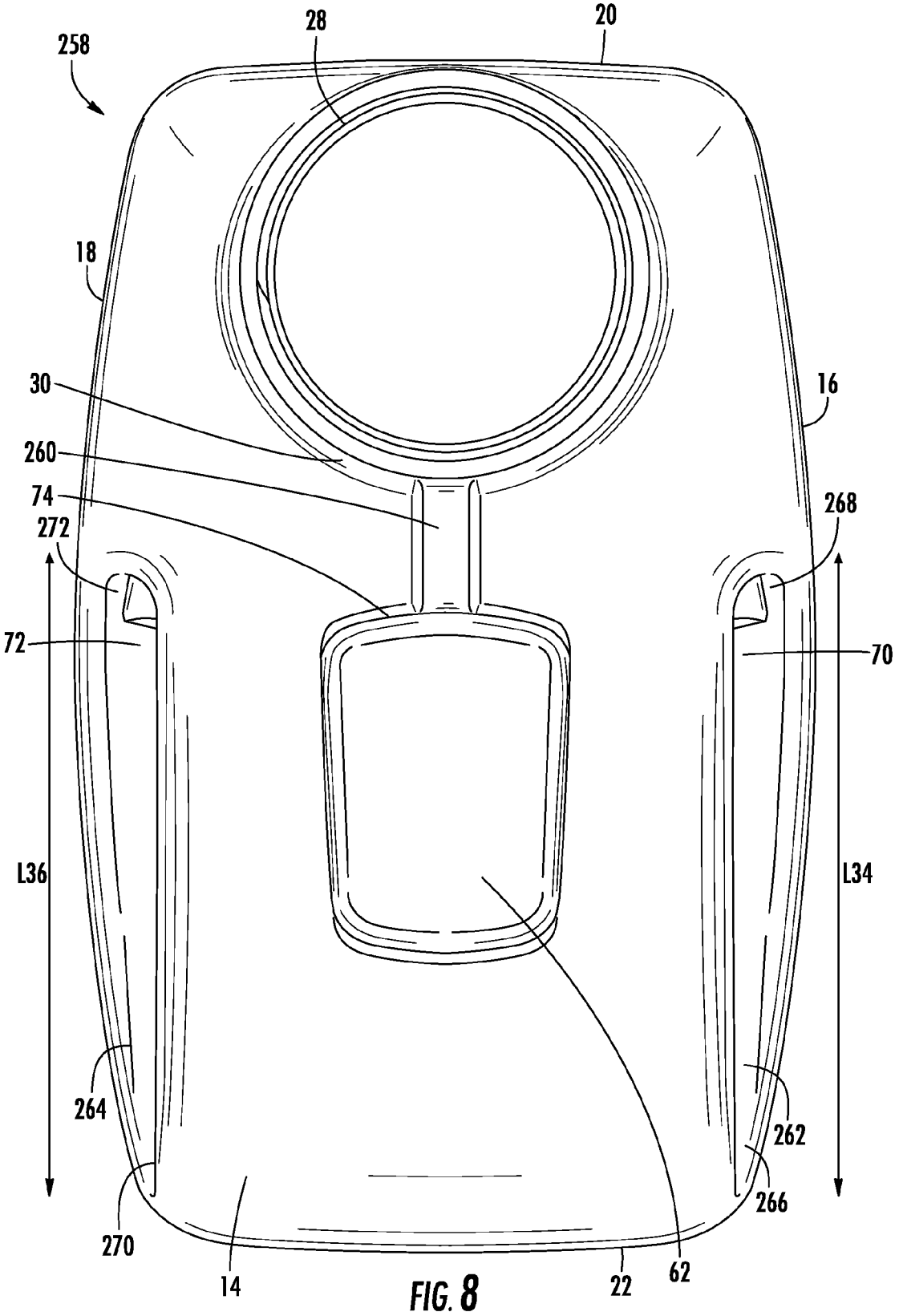
FIG. 8 is the top view of the container in FIG. 7.

Referring to FIG. 7 and FIG. 8, the container body 258 includes a support 260, a first outboard rail track 262 and a second outboard rail track 264. The support 260 extends upwards from the top wall 14 of the container body 258 and is adjacent to a portion of the latch end 74 of the projection 62 and a portion of the exterior surface 30 of the spout 28. The support 260 is generally rectangular in shape.

The first outboard rail track 262 further includes a first receiving end 266, a first engagement end 268 and a length L34. The second outboard rail track 264 further includes a second receiving end 270, a second engagement end 272 and a length L36. The length L34 and the length L36 are substantially similar. The length L34 is greater than the length L16 (see FIG. 4A) and the length L36 is greater than the length L18 (see FIG. 4A). For example, in one embodiment, the lengths L16 and L18 may be 2.1 centimeters and the lengths L34 and L36 may be both 4.5 centimeters.

The first outboard rail track 262 is between the front end wall 20 and the back end wall 22 extending between portions of the top wall 14 and the first side wall 16. The first outboard groove 70 is between the first receiving end 266 and the first engagement end 268 of the first outboard rail track 262. The second outboard rail track 264 is between the front end wall 20 and the back end wall 22 extending between portions of the top wall 14 and the second side wall 18. The second outboard groove 72 is between the second receiving end 270 and the second engagement end 272 of the second outboard rail track 264.

The first outboard rail track 262 is configured to receive the front end 166 of the first outboard rail 50. The second outboard rail track 264 is configured to receive the front end 184 of the second outboard rail 52.

Figure 9:
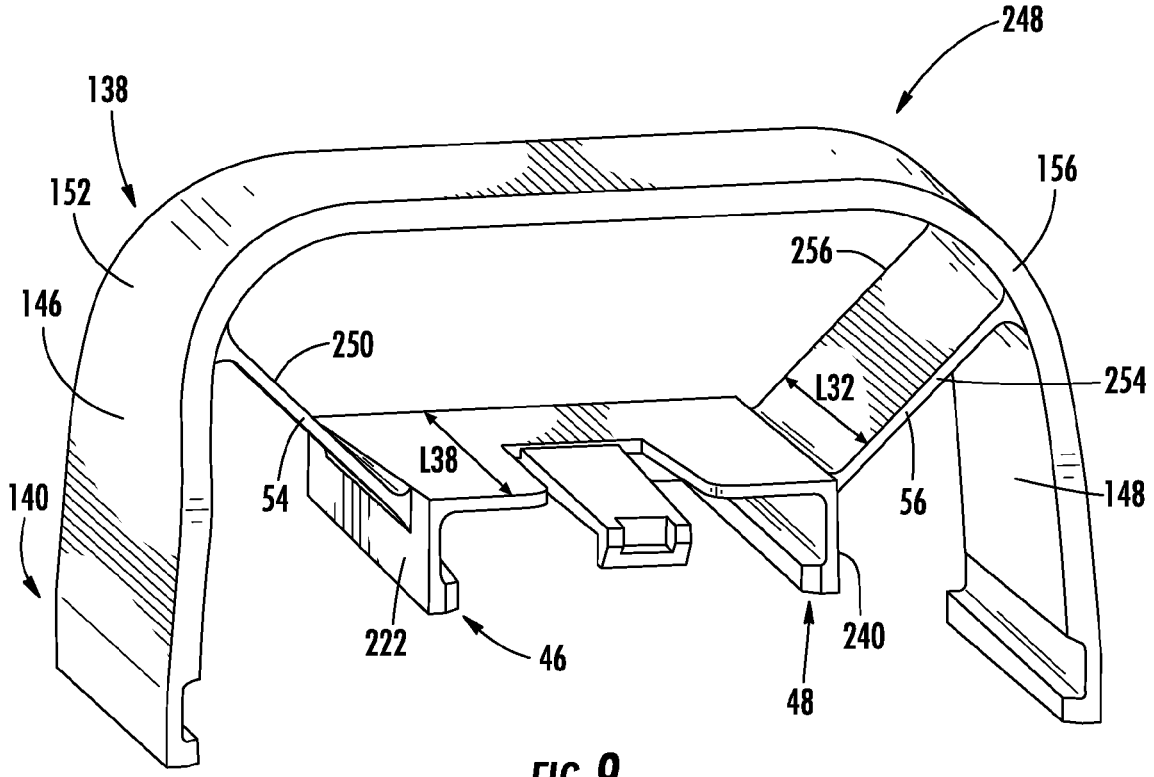
FIG. 9 is an exploded, perspective view of the handle in FIG. 7.

Referring to FIG. 9, another embodiment of the attachable handle 248 is similar to the attachable handle 34. The attachable handle 248 and the attachable handle 34 both include the grip portion 138 and the attachment portion 140. In various embodiments, the first support structure 54 extends from a portion of the first side end 146 near the first grip end portion 152. The second support structure 56 extends from a portion of the second side end 148 near the second grip end portion 156. The first support structure 54 extends at a downward angle away from the first side end 146 and the first grip end portion 152 and towards the exterior surface 222 of the first offset rail 46. The second support structure 56 extends at a downward angle away from the second side end 148 and the second grip end portion 156 and towards the exterior surface 240 of the second offset rail 48.

Referring to FIG. 9, the first support structure 54 includes a front end 250, a back end (not shown) and a length L28 (not shown). The length L28 is the distance between the front end 250 and the back end. The length L28 is less than the length L38. The second support structure 56 includes a front end 254, a back end 256 and a length L32. The length L32 is the distance between the front end 254 and the back end 256. The length L32 is less than the length L38. The length L28 and the length L32 are substantially similar in length. For example, in one embodiment, the lengths L28 and L32 may be 1.86 centimeters and the length L38 may be 1.96 centimeters. The container body 12 with the attachable handle 34 may be delivered to the intended user by molding the attachable handle 34 that includes the rail structure 36 in a first location. The container body 12 may be molded to include the spout 28, the top wall 14, the first side wall 16, the second side wall 18, the front wall 20, the back wall 22, the bottom wall 24, the projection 62, the first offset groove 64, the second offset groove 66, the first outboard groove 70 and the second outboard groove 72 in a second location. The first location is in a different area than the second location. The first location and the second location may be located within the same building, but the molding processes may take place in different rooms. The first location and the second location may also be located on the same property, but the molding processes may take place in different buildings located on the same property. The first location and the second location may be located in different states. For example, the molding process of the first location may take place in California and the molding process of the second location may take place in Delaware. The container body 12 that is molded in the second location is delivered to the first location where the attachable handle 34 is molded. The attachable handle 34 that is molded in the first location may be delivered to the second location where the container body 12 is molded. The attachable handle 34 is engaged with container body 12 when the attachable handle 34 and the container body 12 are in the same location.

In some embodiments, the user may engage the attachable handle 34 and the container body 12 with each other by aligning the first offset rail 46 and the second offset rail 48 with the first offset groove 64 and the second offset groove 66, respectively, and the first outboard rail 50 and the second outboard rail 52 with the first outboard groove 70 and the second outboard groove 72, respectively. Then, by applying pressure to the attachable handle 34, moving the attachable handle 34 from the rear end 76 of the projection 62 to the latch end 74 until the latch surface 44 on the latch 40 is engaged to the fullest extent it can be engaged with the latching engagement surface 68. A portion of the first front surface 86 of the first outboard groove 70 abuts with a portion of the front end 166 of the first outboard rail 50 and a portion of the second front surface 94 of the second outboard groove 72 abuts with a portion of the front end 184 of the second outboard rail 52 preventing the attachable handle 34 to move beyond the first front surface 86 and second front surface 94 and towards the spout 28.

In some embodiments, the user may engage the attachable handle 248 and the container body 258 with each other by aligning the first outboard rail 50 with the first outboard track 262 at the first receiving end 266 with the second outboard rail 52 with the second outboard track 264 at the second receiving end 270. Then, by applying pressure to the attachable handle 248, moving the attachable handle 248 from the first receiving end 266 and the second receiving end 270 towards the first engagement end 268 and the second engagement end 272, respectively. Then, the user aligns the first offset rail 46 and the second offset rail 48 with the first offset groove 64 and the second offset groove 66, respectively, and by applying pressure to the attachable handle 248, moves the attachable handle 248 from the rear end 76 of the projection 62 to the latch end 74 until the latch surface 44 on the latch 40 is engaged to the fullest extent it can be engaged with the latching engagement surface 68.

In various other embodiments, once the attachable handle 34 and the container body 12 are in the same location, the attachable handle 34 may be molded to the container body 12. The first outboard rail 50 and the second outboard rail 52 are molded outside of the first offset rail 46 and the second offset rail 48 in one of the molding steps. In a separate molding step, the first outboard groove 70 and the second outboard groove 72 are molded outside of the first offset groove 64 and the second offset groove 66, respectively. The attachable handle 34 is engaged to the fullest extent with the container body 12 when the first offset groove 64 and the second offset groove 66 are molded in place of the first offset rail 46 and the second offset rail 48, respectively and the first outboard groove 70 and the second outboard groove 72 are molded in place of the first outboard rail 50 and the second outboard rail 52, respectively.

In one embodiment, the container body 12 and the material located in the container body 12 combined accounts for the majority of the total weight of the container 10. The container 10 may be of various weights that may be attributed to multiple factors such as the size, configuration and the material that composes container body 12 and the material located within the container body 12, etc. The attachable handle 34 and the slide structure 36 may also be of various sizes and configurations to accommodate the different sizes and weights of the container body 12. For example, in one embodiment a container body 12 with material that is heavy may have an attachable handle 34 and slide structure 36 that is larger in size which may distribute the weight of the container 10 to assist the user in moving a heavier container 10 than a container 10 with material that is lighter. The various sizes and configurations of the attachable handle 34 and the slide structure 36 may be tailored to the needs of the user of the container 10.

In one embodiment, the attachable handle 34 may be removed from the slide structure 36 and reattached to engage with the slide structure 36 multiple times. The attachable handle 34 and the slide structure 36 may remain intact with each other during multiple uses of the container 10 or the attachable handle 34 and the slide structure 36 may be separated from each other for each individual use of the container 10. Alternative embodiments may have the attachable handle 34 and the slide structure 36 that remain intact with each other once fully engaged.

It should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Other substitutions, modifications, changes and omissions may also be made in the design, operating conditions and arrangement of the various exemplary embodiments without departing from the scope of the present invention.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A container comprising:

a plastic container body for holding a fluid material, the body including a plurality of walls;

a hollow, cylindrical portion extending from an opening in one of the walls, the cylindrical portion including a threaded, exterior surface engageable by a cap, wherein the cylindrical portion is configured to insert or remove material from the container;

an attachable handle including a rail structure and a pair of outboard rails, the rail structure including a pair of opposed, non-parallel, offset rails, and a latch having a latch surface located at the end where the ends of the rails are farthest from each other;

a slide structure including a generally rectangular projection from one of the walls, the projection including a pair of opposed, non-parallel offset grooves and a latching surface intersecting the grooves at the location where the grooves are farthest from each other, the grooves being adapted to mate with the offset rails and be fully engaged by the rails when the latch is engaged with the latching surface;

wherein the outboard rails are outside of the offset rails, and the container body includes a pair of outboard grooves outside of the offset grooves, the outboard rails and outboard grooves being located such that the outboard rails and outboard grooves are not fully engaged unless the latch is engaged with the latching surface.

2. The container of claim 1, wherein the offset rails include a common, longitudinal rail axis, and the angle between the offset rails and longitudinal rail axis is between 1 and 3 degrees, and the offset grooves contain a common, longitudinal groove axis and the angle between offset grooves and the groove axis is substantially the same as the angle between the offset rails and the rail axis.

3. The container of claim 2, wherein the handle includes a generally U-shaped handle portion extending between the outboard rails, a support structure extends between the outboard rails and supports the offset rails and latch such that the latch is located between the offset rails.

4. The container of claim 2, wherein the handle is molded from a thermoplastic.

5. The container of claim 4, wherein the container has a generally rectangular cross-section taken along an axis generally parallel to the central axis of the cylindrical portion.

6. The container of claim 1, wherein the offset rails are engaged with grooves and the offset grooves are engaged with rails.

7. The container of claim 2, wherein the outboard rails are engaged with outboard grooves and the outboard grooves are engaged with outboard rails.

8. A container comprising:

a plastic container body having a plurality of walls for containing a fluid material;

a hollow, cylindrical portion extending from an opening in one of the walls, the cylindrical portion including a threaded, exterior surface engageable by a cap wherein the cylindrical portion is configured for insertion or removal of material from the container;

an attachable handle including a rail structure and a pair of outboard rails, the rail structure including a pair of opposed, substantially equal length offset rails laying within a common plane, the rails each having a close end where the close ends of the rails are at a distance D1, and a distant end where the distant ends of the rails are at a distance D2 greater than D1, and a latch having a latch surface located at the distant ends; and a slide structure including a generally rectangular projection extending from one of the walls, the projection including a pair of opposed, offset grooves laying within a common plane, the grooves being adapted to mate with the offset rails, and a latching surface intersecting the grooves at the location where the grooves mate with the distant ends of the rails, wherein the grooves and rails are fully engaged when the latch is engaged with the latching surface;

wherein the outboard rails are outside of the offset rails, and the container body includes a pair of outboard grooves outside of the offset grooves, the outboard rails and outboard grooves being located such that the outboard rails and outboard grooves are not fully engaged unless the latch is engaged with the latching surface.

9. The container of claim 8, wherein D2 is between 5% and 15% greater than D1.

10. The container of claim 9, wherein the handle includes a generally U-shaped handle portion extending between the outboard rails, and a support structure extending between the outboard rails and supports the offset rails and latch such that the latch is located between the offset rails.

11. The container of claim 10, wherein the handle is molded from a thermoplastic.

12. The container of claim 11, wherein the container has a generally rectangular cross-section taken along an axis generally parallel to the central axis of the cylindrical portion.

13. The container of claim 8, wherein the offset rails are engaged with grooves and the offset grooves are engaged with rails.

14. A container comprising:

a plastic container body for holding material, the body including a plurality of walls;

a hollow, cylindrical portion extending from an opening in one of the walls, the cylindrical portion including a threaded, exterior surface engageable by a cap, wherein the cylindrical portion is configured to insert or remove material from the container;

an attachable handle including a rail structure and a pair of outboard rails, the rail structure including a pair of opposed, non-parallel, offset rails, and a latch having a latch surface located at the end where the ends of the rails are farthest from each other, wherein the outboard rails are outside of the offset rails;

a slide structure including a projection from one of the walls, the projection including a pair of opposed, non-parallel offset grooves and a latching surface intersecting the grooves at the location where the grooves are farthest from each other, the grooves being adapted to mate with the offset rails and be fully engaged by the rails when the latch is engaged with the latching surface.

15. The container of claim 14, wherein the offset rails include a common, longitudinal rail axis, and the offset grooves contain a common, longitudinal groove axis and the angle between offset grooves and the groove axis is substantially the same as the angle between the offset rails and the rail axis.

16. The container of claim 15, wherein the container body includes a pair of outboard grooves below the offset grooves, the outboard rails and outboard grooves being located such that the outboard rails and outboard grooves are not fully engaged unless the latch is engaged with the latching surface.

17. The container of claim 16, wherein the handle includes a substantially horizontal portion parallel with the rail structure, and a support structure extending between the outboard rails and supports the offset rails and latch such that the latch is located between the offset rails.

18. The container of claim 16, wherein the handle is molded from a thermoplastic.

19. The container of claim 18, wherein the container has a generally rectangular cross-section taken along an axis generally parallel to the central axis of the cylindrical portion.

20. The container of claim 16, wherein the projection is generally rectangular, wherein the offset rails are engaged with grooves and the offset grooves are engaged with rails and the outboard rails are engaged with outboard grooves and the outboard grooves are engaged with outboard rails.

* * * * *